US005400048A

United States Patent [19]

Shimada et al.

[11] Patent Number: 5,400,048

[45] Date of Patent: Mar. 21, 1995

[54] ACTIVE MATRIX DRIVING APPARATUS AND AN ACTIVE MATRIX DRIVING METHOD

[75] Inventors: Shinji Shimada, Kashihara; Hiroshi Yoneda, Ikoma, both of Japan

[73] Assignee: Sharp Kabushiki Kaisha, Osaka, Japan

[21] Appl. No.: 110,859

[22] Filed: Aug. 24, 1993

[30] Foreign Application Priority Data

Aug. 25, 1992 [JP] Japan ..... 4-226233

[51] Int. Cl.[6] ..... G09G 3/36

[52] U.S. Cl. ..... 345/97; 345/94

[58] Field of Search ..... 345/94, 97, 87, 99, 345/95

[56] References Cited

U.S. PATENT DOCUMENTS

| | | | |
|---|---|---|---|
| 4,655,561 | 4/1987 | Kanbe | 359/56 |
| 4,712,872 | 12/1987 | Kanbe | 359/56 |
| 4,944,575 | 7/1990 | Aigrain et al. | 359/56 |
| 5,092,665 | 3/1992 | Kanbe | 345/97 |
| 5,227,900 | 7/1993 | Inaba | 345/97 |
| 5,267,065 | 11/1993 | Taniguchi | 345/97 |
| 5,296,953 | 3/1994 | Kanbe | 345/87 |

FOREIGN PATENT DOCUMENTS 0367531 5/1990 European Pat. Off. .

*Primary Examiner*—Alvin E. Oberley
*Assistant Examiner*—Minsun Oh
*Attorney, Agent, or Firm*—David G. Conlin; Milton Oliver

[57] ABSTRACT

An active matrix driving method for driving a display apparatus including a plurality of pixels for receiving image data, a ferroelectric member for controlling the plurality of the pixels, and a plurality of scanning signal lines and a plurality of data signal lines for driving the plurality of the pixels utilizing a memory function caused by spontaneous polarization of the ferroelectric member. The matrix driving method includes the steps of applying a reset pulse having a first polarity and a data writing pulse having a second polarity to one scanning signal line selected from the plurality of the scanning signal lines throughout a specified selection period; applying a reset pulse having the second polarity and a data pulse having the first polarity or a level of 0 to each of the plurality of the data signal lines in synchronization with the reset pulse and the data writing pulse applied to the selected scanning signal line; applying a reset compensating pulse having the second polarity and a data writing prohibiting pulse having the first polarity or a level of 0 to the selected scanning signal line throughout a period other than the specified selection period; and applying a reset pulse having the second polarity and a data pulse having the first polarity or a level of 0 to each of the plurality of the data signal lines in synchronization with the reset compensating pulse and the data writing prohibiting pulse applied to the selected scanning signal line.

7 Claims, 9 Drawing Sheets

ACTIVE MATRIX DRIVING APPARATUS AND AN ACTIVE MATRIX DRIVING METHOD

BACKGROUND OF THE INVENTION

1. Field of the Invention

The present invention relates to an active matrix driving apparatus and an active matrix driving method used for, for example, an active matrix liquid crystal display device including a ferroelectric layer having a memory function, instead of a switching device.

2. Description of the Related Art

According to a known active matrix driving apparatus, an electric field is applied to a liquid crystal and the like, utilizing a memory function of a ferroelectric layer which is realized by spontaneous polarization thereof. In such an active matrix driving apparatus, before a data pulse corresponding to display data is applied to the ferroelectric layer, a reset pulse having an opposite polarity to the data pulse should be applied to the ferroelectric layer in order to cause spontaneous polarization in the ferroelectric layer in an opposite polarity to that of the display data.

FIG. 13 shows a liquid crystal display device (hereinafter, referred to as the "LCD device") having data signal lines $X_1$, $X_2$, $X_3$, . . . and scanning signal lines $Y_1$, $Y_2$, $Y_3$, . . . in a lattice. FIG. 14 shows a conventional manner in which such an LCD device is AC-driven by way of field-by-field inversion. In a first field, a reset pulse R having a potential of $-V$ is applied to all the scanning signal lines Y, and then a data writing pulse W having a potential of $+V$ is sequentially applied to each of the scanning signal lines Y. In a second field, by inversion, a reset pulse R of $+V$ is applied to all the scanning signal lines Y, and then a data writing pulse W of $-V$ is sequentially applied to each of the scanning signal lines Y. To a data signal line $X_1$, for example, a reset pulse R of $\pm V$ having an opposite polarity to that of the reset pulse R applied to the scanning signal lines Y is applied. Then, to the data signal line $X_1$, a data pulse D of $\pm V$ having an opposite polarity to the data writing pulse W is applied when a display state is ON, and a data pulse D having a potential of 0 V is applied when the display state is OFF. As a consequence, for example, an area of a ferroelectric layer corresponding to a pixel at ($X_1$, $Y_2$) in FIG. 13 is first supplied with a reset pulse R of $\pm 2$ V and then with a data pulse D of $\pm V$ having an opposite polarity to that of the reset pulse R applied thereto or a data pulse D having a potential of 0 V in each field. When a data writing pulse W is applied to the scanning signal line $Y_2$, the above area of the ferroelectric layer is supplied with a data pulse D of $\pm V$ or $\pm 2$ V in correspondence with the data pulse D applied to the data signal line $X_1$. When the above area of the ferroelectric layer is supplied with a data pulse D of $\pm 2$ V having an opposite polarity to the reset pulse R applied thereto, data for the display state of ON is stored in the ferroelectric layer corresponding to the pixel at ($X_1$, $Y_2$).

In the above-mentioned active matrix driving apparatus and method, since a reset pulse R is first applied in each field, a display screen first goes into a state of displaying nothing, and then pixels of the display screen are sequentially enabled to display data in the order of being scanned by the scanning signal lines Y. As a result, the pixels on the scanning signal lines $Y_1$ are enabled to display data immediately after the display screen goes into the state of displaying nothing, but the pixels on the scanning signal lines $Y_2$ and $Y_3$ are enabled to display data with a delay. The pixels on the other scanning signal lines are enabled to display data with a further delay, and thus are enabled to display data for quite a short period until the next field.

For the above-mentioned reason, an LCD device driven by a conventional active matrix driving apparatus and method utilizing a memory function of a ferroelectric layer has problems in that there occurs a large difference in display contrast between a pixel scanned first and a pixel scanned much later. Such a difference significantly lowers the display quality in a still picture as well as in a moving picture. The uses of the LCD device is quite restricted by these problems.

SUMMARY OF THE INVENTION

The active matrix driving method of this invention for driving a display device including a plurality of pixels for receiving image data, a ferroelectric member for controlling the plurality of the pixels, and a plurality of scanning signal lines and a plurality of data signal lines for driving the plurality of the pixels utilizing a memory function caused by spontaneous polarization of the ferroelectric member is provided. The active matrix driving method includes the steps of applying a reset pulse having a first polarity and a data writing pulse having a second polarity to one scanning signal line selected from the plurality of the scanning signal lines throughout a specified selection period; applying a reset pulse having the second polarity and a data pulse having the first polarity or a level of 0 to each of the plurality of the data signal lines in synchronization with the reset pulse and the data writing pulse applied to the selected scanning signal line; applying a reset compensating pulse having the second polarity and a data writing prohibiting pulse having the first polarity or a level of 0 to the selected scanning signal line throughout a period other than the specified selection period; and applying a reset pulse having the second polarity and a data pulse having the first polarity or a level of 0 to each of the plurality of the data signal lines in synchronization with the reset compensating pulse and the data writing prohibiting pulse applied to the selected scanning signal line.

In one embodiment of the invention, an absolute value of the reset compensating pulse is equal to an absolute value of the reset pulse, and an absolute value of the data writing prohibiting pulse is equal to or less than an absolute value of the data pulse, throughout a period other than the specified selection period.

In another embodiment of the invention, the specified period is included in a field, and the method further includes the step of inverting the first polarity and the second polarity field by field.

In still another embodiment of the invention, the specified period is included in a field; the data writing prohibiting pulse has the first polarity from a beginning of the field to a beginning of the specified selection period, and the data writing prohibiting pulse has a level of 0 from an end of the specified selection period to an end of the field; and the method further includes the step of inverting the first polarity and the second polarity field by field.

In still another embodiment of the invention, at least one specified selection period is included in a frame; and the method further includes the step of inverting the first polarity and the second polarity frame by frame.

In still another embodiment of the invention, at least one specified selection period is included in a frame; the data writing prohibiting pulse has the first polarity from a beginning of the frame to a beginning of the earliest specified selection period of at least one specified selection period, and the data writing prohibiting pulse has a level of 0 from an end of the first specified selection period to an end of the frame; and the method further includes the step of inverting the first polarity and the second polarity frame by frame.

In another aspect of the invention, an active matrix driving apparatus for driving a display device including a plurality of pixels for receiving image data, a ferroelectric member for controlling the plurality of the pixels, and a plurality of scanning signal lines and a plurality of data signal lines for driving the plurality of the pixels utilizing a memory function caused by spontaneous polarization of the ferroelectric member is provided. The active matrix driving apparatus includes a signal driving device for applying a reset pulse having a first polarity and a data writing pulse having a second polarity to one scanning signal line selected from the plurality of the scanning signal lines throughout a specified selection period, and for applying a reset compensating pulse having the second polarity and a data writing prohibiting pulse having the first polarity or a level of 0 to the selected scanning signal line throughout a period other than the specified selection period; and a data signal driving device for applying a reset pulse having the second polarity and a data pulse having the first polarity or a level of 0 to each of the plurality of the data signal lines in synchronization with the reset pulse and the data writing pulse applied to the selected scanning signal line throughout the specified selection period, and for applying a reset pulse having the second polarity and a data pulse having the first polarity or a level of 0 to each of the plurality of the data signal lines in synchronization with the reset compensating pulse and the data writing prohibiting pulse applied to the selected scanning signal line throughout a period other than the specified selection period.

Thus, the invention described herein makes possible an advantage of providing an active matrix driving apparatus and an active matrix driving method for enabling all pixels to display data in a uniform period irrespective of which order the pixels are scanned, by applying a reset pulse immediately before a data pulse is applied to each of a plurality of scanning signal lines.

This and other advantages of the present invention will become apparent to those skilled in the art upon reading and understanding the following detailed description with reference to the accompanying figures.

DESCRIPTION OF THE PREFERRED EMBODIMENTS

A principle for an active matrix driving apparatus and method according to the present invention will be described with reference to FIGS. 7 to 12.

Figure 7:
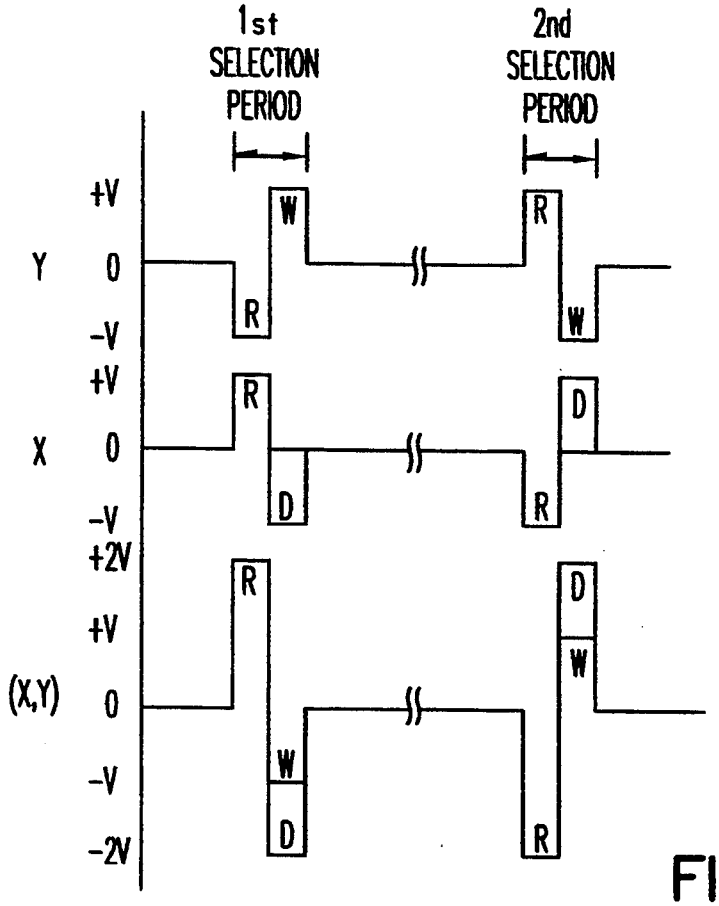
FIG. 7 is a time chart showing pulses applied to data signal lines and scanning signal lines of a dot-matrix display device, for illustrating a principle of the present invention.

As is shown in FIG. 7, a scanning signal line driving device applies a reset pulse R of −V and a data writing pulse W of +V to a scanning signal line Y during a first selection period of the scanning signal line Y. A data signal line driving device applies a reset pulse R of +V and a data pulse D of −V or 0 V to a data signal line X in synchronization with the reset pulse R and the data writing pulse W which are applied to the scanning signal line Y. In this case, an area of a ferroelectric layer corresponding to a pixel (X, Y) where the scanning signal line Y and the data signal line X cross each other is first supplied with a reset pulse R of +2 V and then with a data pulse D of −2 V or −V biased by the data writing pulse W. Then, in a second selection period of the scanning signal line Y, a reset pulse R and a data writing pulse W each having an opposite polarity to that of the pulse applied in the first selection period are applied. As a consequence, a data pulse D, biased by the data writing pulse W, having an opposite polarity to that of the data pulse D applied in the first selection period is applied to the above area of the ferroelectric layer, and thus the AC driving is performed.

Figure 8:
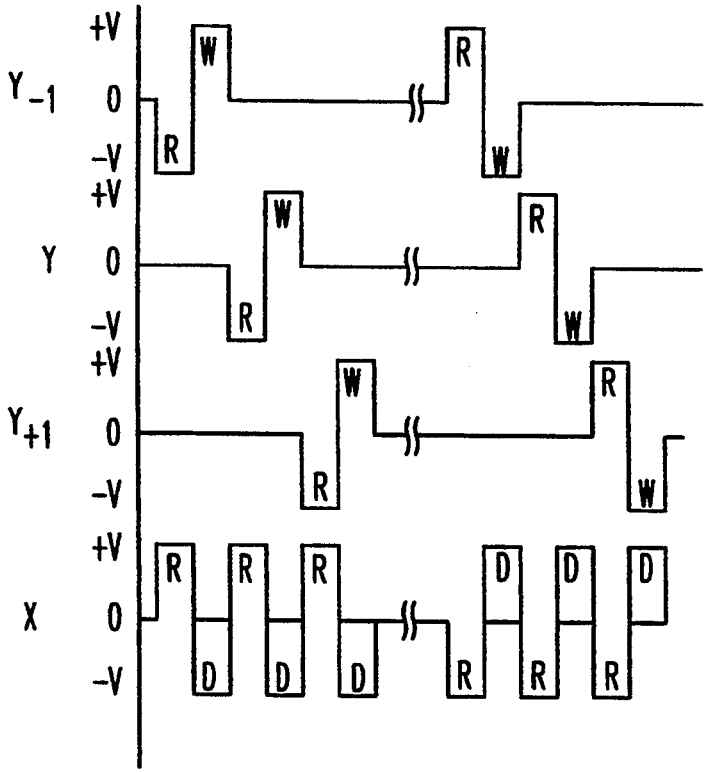
FIG. 8 is a time chart showing pulses applied to data signal lines and scanning signal lines of a dot-matrix display device, for illustrating a principle of the present invention.
Figure 9:
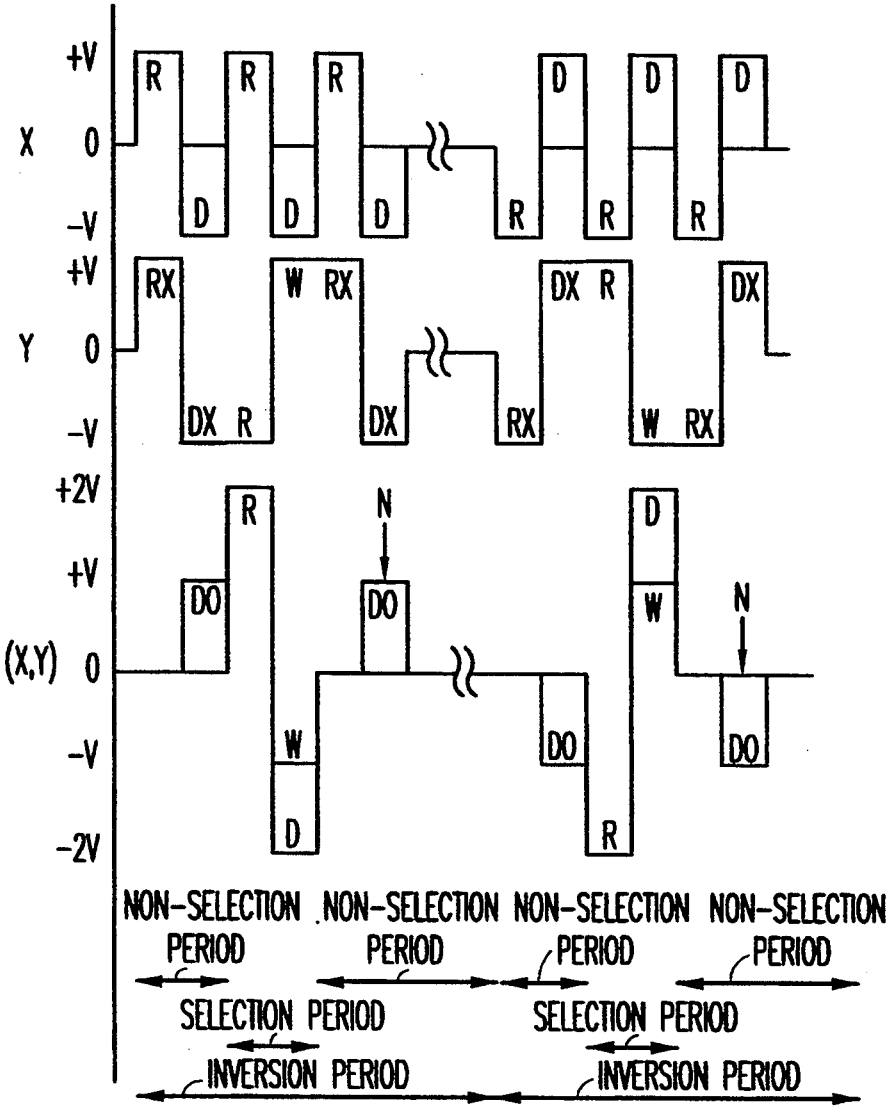
FIG. 9 is a time chart showing pulses applied to data signal lines and scanning signal lines of a dot-matrix display device, for illustrating a principle of the present invention.
Figure 10:
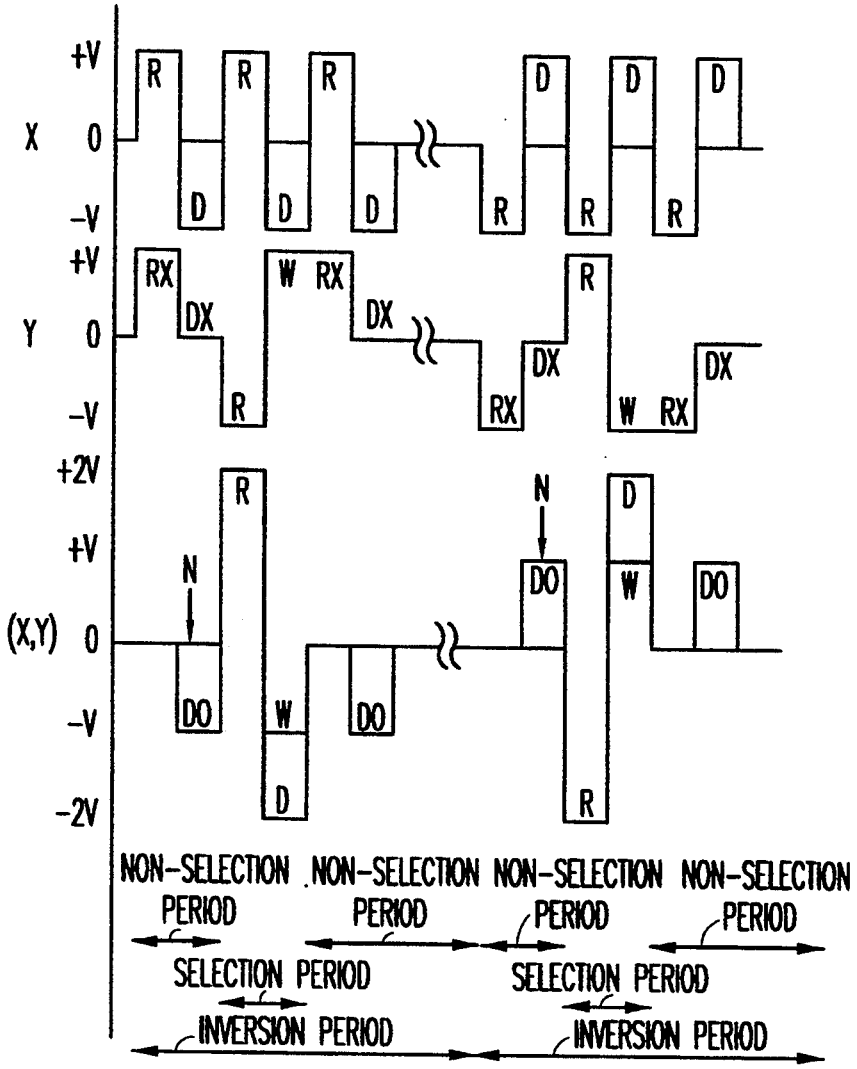
FIG. 10 is a time chart showing pulses applied to data signal lines and scanning signal lines of a dot-matrix display device, for illustrating a principle of the present invention.

Practically, as is shown in FIG. 8, a reset pulse R and a data writing pulse W are also applied to the scanning signal lines $Y_{-1}$ and $Y_{+1}$ each adjacent to the scanning signal line Y. The scanning signal line $Y_{-1}$ is supplied with the pulses R and W before the scanning signal line Y is, and the scanning signal line $Y_{+1}$ is supplied with the pulses R and W after the scanning signal line Y is. Accordingly, the data signal line driving device supplies the data signal line X with reset pulses R and data pulses D corresponding to the scanning signal lines $Y_{-1}$, Y and $Y_{+1}$ sequentially. Such a sequential application produces an unnecessary electric field in a non-selection period, which should be prevented from being applied to an area of the ferroelectric layer corresponding to a pixel in a state of being in a non-selection period. In order to attain such prevention, as is shown in FIG. 9, the scanning signal line driving device supplies the scanning signal line Y with a reset compensating pulse RX of +V having an identical polarity with that of the reset pulse R applied to the data signal line X and also with a data writing prohibiting pulse DX of ±V having an identical polarity with that of the data pulse D of ±V. As is shown in FIG. 10, the data writing prohibiting pulse DX may have a potential of 0 V when the data pulse D has a potential of 0 V.

According to such an active matrix driving apparatus and method, areas of the ferroelectric layer corresponding to the pixels on each scanning signal line are reset immediately before a data writing pulse is applied. Thus, the pixels can be enabled to display data in a uniform period irrespective of which order the pixels are scanned.

When the scanning signal line driving device and the data signal line driving device apply the pulses shown in FIG. 9, the area of the ferroelectric layer corresponding to the pixel (X, Y) is supplied with an invalid data pulse DO (indicated by N) having an opposite polarity to that of the data pulse D during a non-selection period. As is shown in FIG. 10, in a case where a data writing prohibiting pulse DX applied to the scanning signal line Y has a potential of 0 V, the above area of the ferroelectric layer is supplied with an invalid data pulse DO (indicated by N) having an identical polarity with that of the data pulse D during a non-selection period. Accordingly, in the case of FIG. 9, an invalid data pulse D0 (indicated by N) applied during a non-selection period, which lasts from an end of a selection period of an inversion period to an end of the inversion period, has an opposite polarity to that of the data pulse D applied immediately before the invalid data pulse D0 (indicated by N). In the case of FIG. 10, an invalid data pulse D0 (indicated by N) applied during a non-selection period, which lasts from a beginning of an inversion period to a beginning of the selection period of the inversion period, has an opposite polarity to that of the data pulse D applied immediately before the invalid data pulse D0 (indicated by N).

Figure 11:
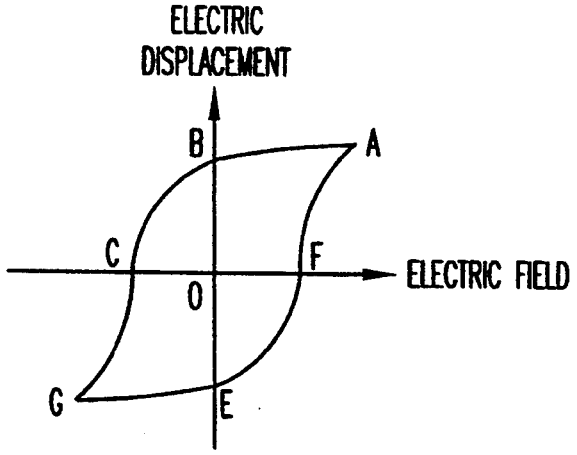
FIG. 11 is a graph illustrating the hysteresis characteristic of a ferroelectric layer.

FIG. 11 shows a hysteresis characteristic of the electric field vs. electric displacement relationship obtained when an electric field is externally applied to the ferroelectric layer. When a sufficiently large electric field is applied to the ferroelectric layer through a data pulse D, thus to displace electricity to a level of A or G, and then an electric field having an identical polarity with the data pulse D is kept applied, the electric displacement only moves on a curve A-B or G-E. Thus, the electric displacement is hardly changed. By contrast, when an electric field having an opposite polarity to the data pulse D is applied, the electric displacement moves on a curve B-C or E-F. Thus, an absolute value of the electric displacement is drastically lowered. Accordingly, when an invalid data pulse D0 (indicated by N) of +V having an opposite polarity to that of the data pulse D immediately before the invalid data pulse D0 (indicated by N) is applied to the area of the ferroelectric layer corresponding to the pixel (X, Y) during the non-selection period as in shown in FIGS. 9 and 10, an absolute value of the electric displacement is rapidly lowered. As a result, the memory function of the ferroelectric layer realized by the spontaneous polarization is almost completely lost.

Figure 12:
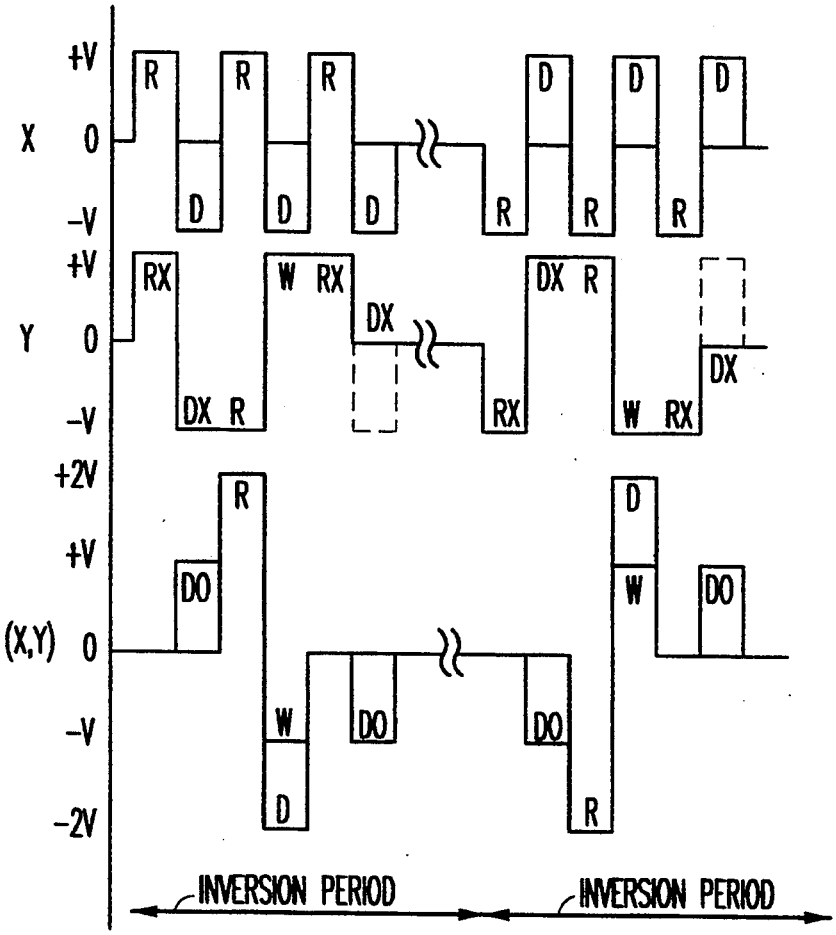
FIG. 12 is a time chart showing pulses applied to data signal lines and scanning signal lines of a dot-matrix display device, for illustrating a principle of the present invention.
Figure 13:
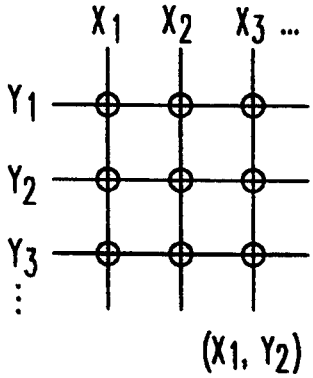
FIG. 13 PRIOR ART
FIG. 13 is a schematic view of a dot-matrix display device for which a conventional active matrix driving apparatus is used.
Figure 14:
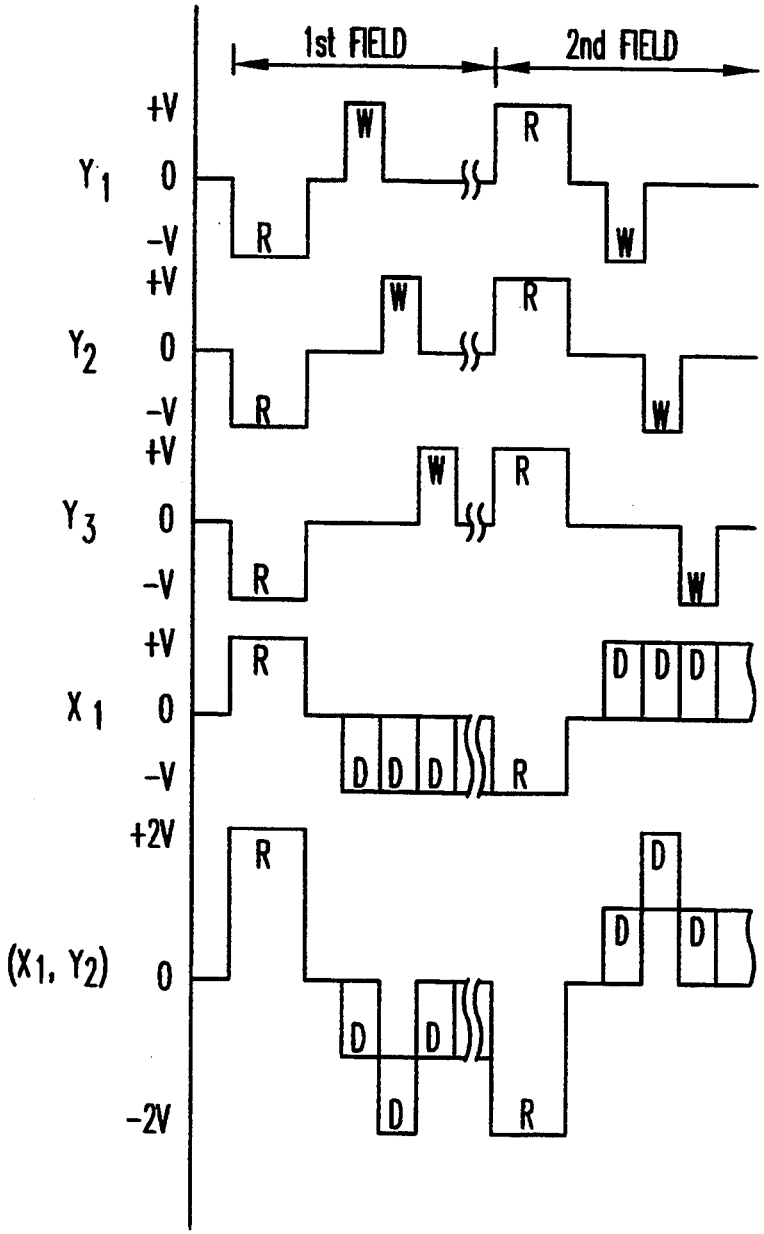
FIG. 14 PRIOR ART
FIG. 14 is a time chart showing pulses applied to data signal lines and scanning signal lines of a dot-matrix display device by the conventional active matrix driving apparatus.

In order to avoid such an inconvenience, a data writing prohibiting pulse DX of ±V is applied to the scanning signal line Y during the non-selection period from the beginning of the inversion period to the beginning of the selection period as is shown in FIG. 9, and a data writing prohibiting pulse DX of 0 V is applied to the scanning signal line Y during the non-selection period from an end of the selection period to an end of the inversion period as is shown in FIG. 10. In such a case, as is shown in FIG. 12, the area of the ferroelectric layer corresponding to the pixel (X, Y) is supplied with a data pulse D0 having an identical polarity with that of the data pulse D applied immediately before the data pulse D0. In the case of a field-by-field inversion, only one selection period is provided during one inversion period. In the case of a frame-by-frame inversion, a plurality of selection periods are provided during one inversion period. In the latter case, the potentials of data writing prohibiting pulses DX are different between before and after the earliest selection period of the plurality of the selection periods.

According to the present invention, a reset pulse is applied immediately before a data writing pulse is applied, thereby prohibiting an invalid data pulse which has an opposite polarity to that of a data pulse applied immediately before the invalid data pulse from being applied to the ferroelectric layer.

Hereinafter, the present invention will be described by way of illustrating examples with reference to the accompanying drawings.

EXAMPLE 1

An active matrix driving apparatus and method in an example of the present invention will be described with reference to FIGS. 1 to 4.

Figure 1:
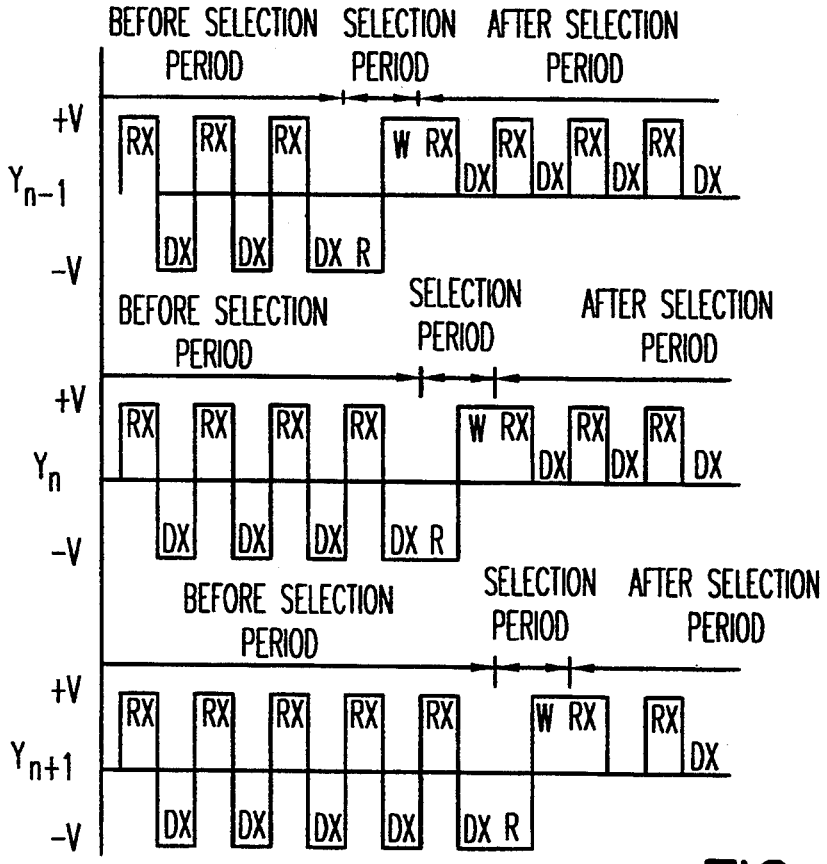
FIG. 1 is a time chart showing pulses applied to scanning signal lines of a dot-matrix display device by an active matrix driving apparatus in one example of the present invention.
Figure 2:
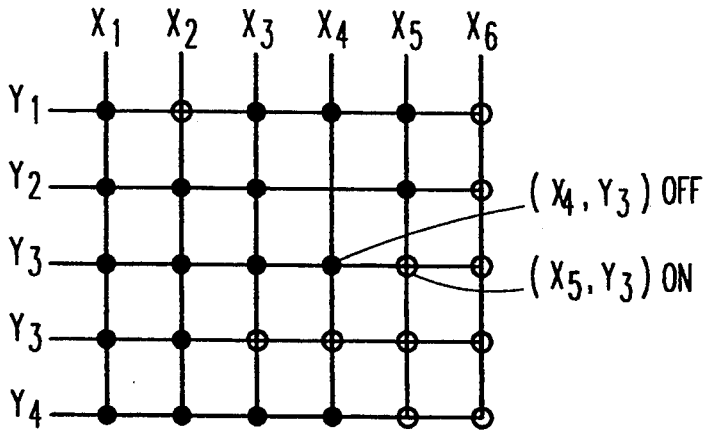
FIG. 2 is a schematic view of a dot-matrix display device having 5+6 pixels used in the example of the present invention.
Figure 3:
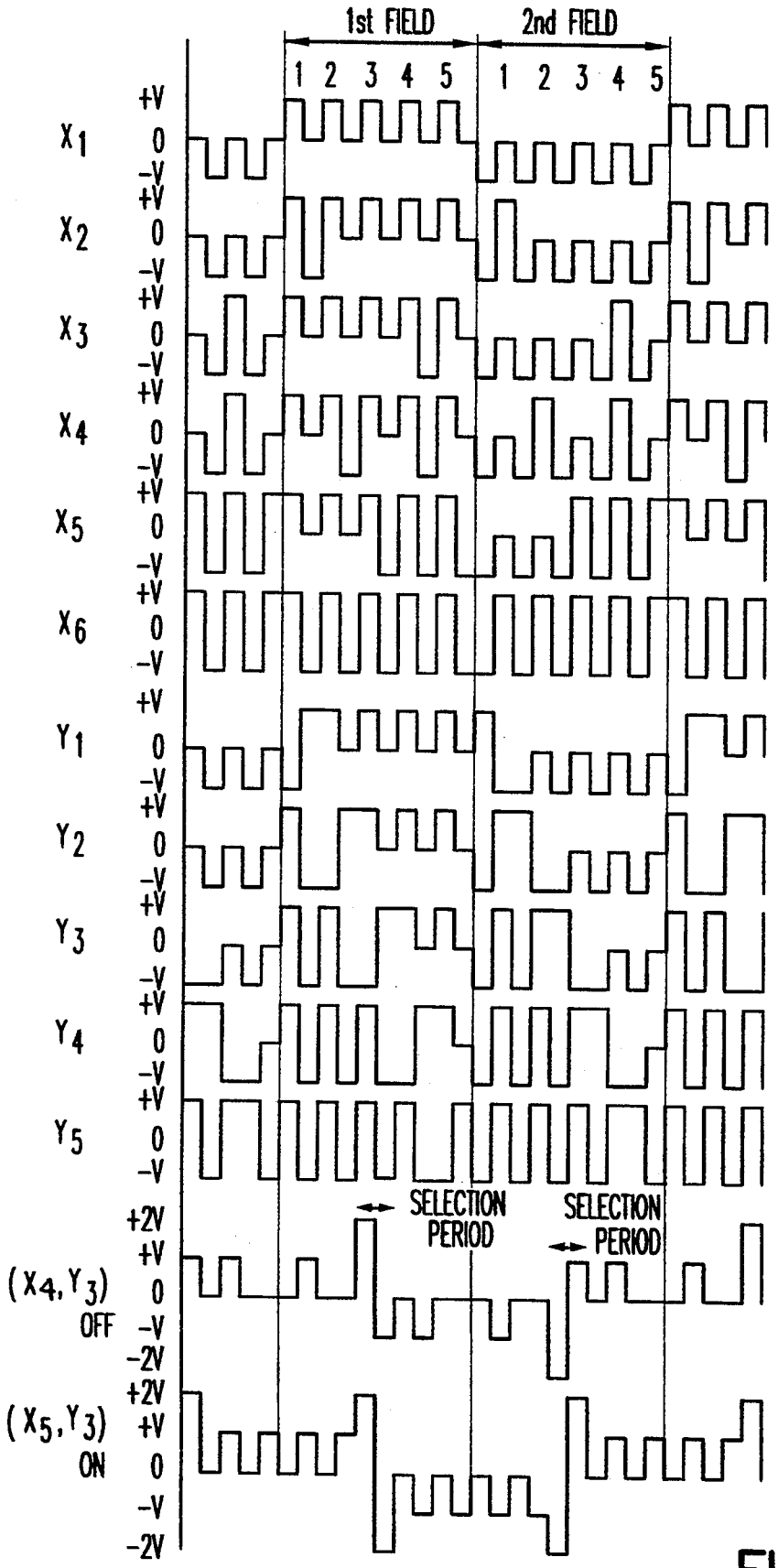
FIG. 3 is a time chart showing pulses applied to data signal lines and the scanning signal lines of the dot-matrix display device shown in FIG. 2.
Figure 4:
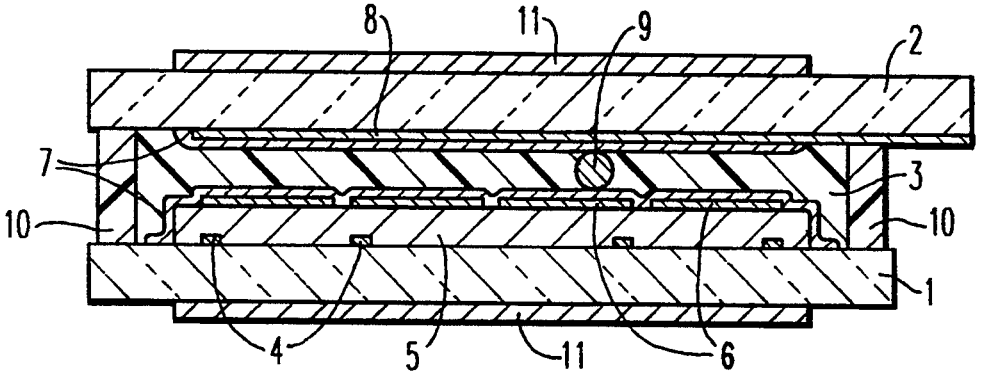
FIG. 4 is a cross sectional view of an active matrix LCD device for which the active matrix driving apparatus and method in the example of the present invention is used.

FIG. 1 is a time chart showing pulses applied to scanning signal lines by the active matrix driving apparatus. FIG. 2 is a schematic view of a dot-matrix display device having 5×6 pixels. FIG. 3 is a time chart showing pulses applied to data signal lines and the scanning signal lines of the dot-matrix display device shown in FIG. 2. FIG. 4 is a cross sectional view of an active matrix LCD device for which the active matrix driving apparatus and method is used.

As is shown in FIG. 4, the active matrix LCD device includes a liquid crystal layer 3 interposed between substrates 1 and 2 which are opposed to each other with a spacer 9 therebetween. On a surface of the substrate 1, the surface being opposed to the substrate 2, a signal electrode 4, a ferroelectric layer 5, pixel electrodes 6, and an alignment film 7 are provided. On a surface of the substrate 2, the surface being opposed to the substrate 1, a counter electrode 8 and another alignment film 7 are provided. The liquid crystal layer 3 interposed between the substrates 1 and 2 is sealed by a sealing member 10. The surfaces of the substrates 1 and 2 which are not opposed to each other each have a polarizing plate 11 thereon.

The substrates 1 and 2 are formed of a transparent glass, a polymeric compound or the like. The signal electrode 4 is formed of a conductive thin film formed of aluminum, tantalum, titanium, molybdenum, copper, ITO (indium tin oxide) or the like. The ferroelectric layer 5 is formed of a ferroelectric polymer such as poly(vinylidene fluoride), a copolymer of poly(vinylidene fluoride) and trifluoroethylene, a copolymer of poly(vinylidene fluoride) and tetrafluoroethylene or a copolymer of poly(vinylidene cyanide) and vinyl acetate, an inorganic ferroelectric material such as barium titanate, PZT[Pb(Zr, Ti)$O_3$] or PLZT[(Pb, La) (Zr, Ti)$O_3$], or other ferroelectric liquid crystal polymers and the like. The pixel electrodes 6 and the counter electrode 8 are formed of a conductive thin film formed of ITO or the like.

The LCD device is formed in the following manner. The pixel electrodes 6 formed on the substrate 1 and the counter electrode 8 formed on the substrate 2 are each coated with the alignment film 7 and then cured. After that, the substrates 1 and 2 having the above-mentioned electrodes and layers are subjected to a specified alignment treatment. Then, the substrates 1 and 2 are arranged to be opposed to each other with the spacer 9 therebetween, and pasted to each other through the sealing member 10 provided along peripheries thereof. Then, liquid crystal particles are injected between the substrates 1 and 2 until a space therebetween is filled with the liquid crystal particles, thereby forming the liquid crystal layer 3. The polarizing plates 11 are then provided on the surfaces of the substrates 1 and 2.

The liquid crystal used in the above-mentioned LCD device may be any of a twisted-nematic type, a super twisted-nematic type, a electrically controlled birefringence type, a dynamic scattering type, a polymer diffusion type, a polymer matrix type, or a guest-host type. A ferroelectric or anti-ferroelectric liquid crystal may also be used.

The active matrix LCD device shown in FIG. 4 is equipped with a driving device for applying display data to the data signal lines while applying scanning pulses to the scanning signal lines sequentially.

The driving device, for example, applies pulses shown in FIG. 1 to three scanning signal lines $Y_{n-1}$, Yn, and $Y_{n+1}$. That is, in the field shown in FIG. 1, the scanning signal lines $Y_{n-1}$, $Y_n$, and $Y_{n+1}$ are each supplied with a reset compensating pulse RX of +V and a data writing prohibiting pulse DX of −V or 0 V sequentially. One selection period is provided in each of the scanning signal lines $Y_{n-1}$, $Y_n$, and $Y_{n+1}$ in each field in the order of $Y_{n-1}$, $Y_n$, and $Y_{n+1}$. During each selection period, a reset pulse R of −V and a data writing pulse W of +V are applied. The data signal lines (not shown) are each supplied with a reset pulse R of +V and a data pulse of −V or 0 V.

The reset compensating pulse RX applied to each of the scanning signal lines $Y_{n-1}$, $Y_n$, and $Y_{n+1}$ prevents an application of a reset pulse R of +V applied to the data signal line to an area of the ferroelectric layer 5 corresponding to a pixel in a state of being in a non-selection period. For this purpose, the reset compensating pulse RX has an identical polarity with that of the reset pulse R applied to the data signal line. The data writing prohibiting pulse DX applied to the scanning signal lines $Y_{n-1}$, $Y_n$, and $Y_{n+1}$ prevents an application of a data pulse of −V or 0 V applied to the data signal line to an area of the ferroelectric layer 5 corresponding to a pixel in a state of being in a non-selection period. For this purpose, the data writing prohibiting pulse DX has a potential in the range of −V to 0 V in an identical polarity with that of the data pulse. Before a selection period, i.e., a non-selection period from a beginning of the field to a beginning of the selection period of the-field, the data writing prohibiting pulse DX is set to have a potential of −V, an absolute value of which is highest in the range of −V to 0 V. After the selection period, i.e., another non-selection period from an end of the selection period of the field to an end of the field, the data writing prohibiting pulse DX is set to have a potential of 0 V, an absolute value of which is lowest in the range of −V to 0 V. Accordingly, the potentials of the pulses applied to the scanning signal lines Y and the data signal lines X and the potential of the pulse applied to the area of the ferroelectric layer 5 corresponding to the pixel are as shown in Table 1.

TABLE 1

| | | Before selection period | | Selection period | | After selection period | |
|---|---|---|---|---|---|---|---|
| | | Reset pulse | Data pulse | Reset pulse | Data pulse | Reset pulse | Data pulse |
| Scanning signal line Y | | +V | −V | −V | +V | +V | 0 |
| Data signal line X | ON | +V | −V | +V | −V | +V | −V |
| | OFF | +V | 0 | +V | 0 | +V | 0 |
| Voltage on ferro-electric layer | ON | 0 | 0 | +2 V | −2 V | 0 | −V |
| | OFF | 0 | +V | +2 V | −V | 0 | 0 |

FIG. 3 shows waveforms of pulses applied to the data signal lines X and scanning signal lines Y in the case of field-by-field inversion. For simplicity, the dot-matrix LCD device having 5×6 pixels shown in FIG. 2 is used. In FIG. 2, white dots indicate a display state of ON, whereas black dots indicate a display state of OFF.

For example, areas of the ferroelectric layer 5 corresponding to pixels at ($X_4$, $Y_3$) and ($X_5$, $Y_3$) provided on the scanning signal line $Y_3$ are each supplied with a reset pulse R of +2 V during a selection period in a first field. Then, the areas of the ferroelectric layer 5 corresponding to the pixels at ($X_4$, $Y_3$) and ($X_5$, $Y_3$) are each supplied with a data pulse of either −V or −2 V. Each pixel is in a display state of ON or OFF by the difference in the potential of such data pulses. During a selection period in a second field, the above areas of the ferroelectric layer 5 are each supplied with a reset pulse R of −2 V. Then, the areas of the ferroelectric layer 5 corresponding to the pixels at ($X_4$, $Y_3$) and ($X_5$, $Y_3$) are each supplied with a data pulse of either +V or +2 V. The liquid crystal layer 3 is AC-driven by such application of pulses having opposite polarities to those of the pulses applied in the preceding field. The areas of the ferroelectric layer 5 corresponding to the pixels at ($X_4$, $Y_3$) and ($X_5$, $Y_3$) are continually supplied with a pulse of −V which is identical in the polarity with that of the data pulse applied immediately before the pulse or supplied with a pulse of 0 V throughout a period after application of the data pulse in the selection period of the first field until application of the data pulse in the selection period of the second field. Thereafter, throughout a period between application of the data pulses in the selection periods of two adjacent fields, a pulse of ±V in an identical polarity with that of the data pulse immediately before the pulse or a pulse of 0 V is applied.

In this example, an area of the ferroelectric layer 5 corresponding to each pixel is supplied with a reset pulse applied immediately before the application of a data pulse in each selection period. Accordingly, the written data can be retained in a uniform period between the selection periods of two adjacent fields irrespective of which order the pixels are scanned. After a data pulse is applied, a pulse having a potential in an identical polarity with that of the data pulse immediately before the pulse or of 0 V is applied. In such a method, the memory function of the ferroelectric layer 5, which is generally lost by the application of a pulse having a potential of an opposite polarity to that of the data pulse applied immediately before the pulse, is not lost.

EXAMPLE 2

Figure 5:
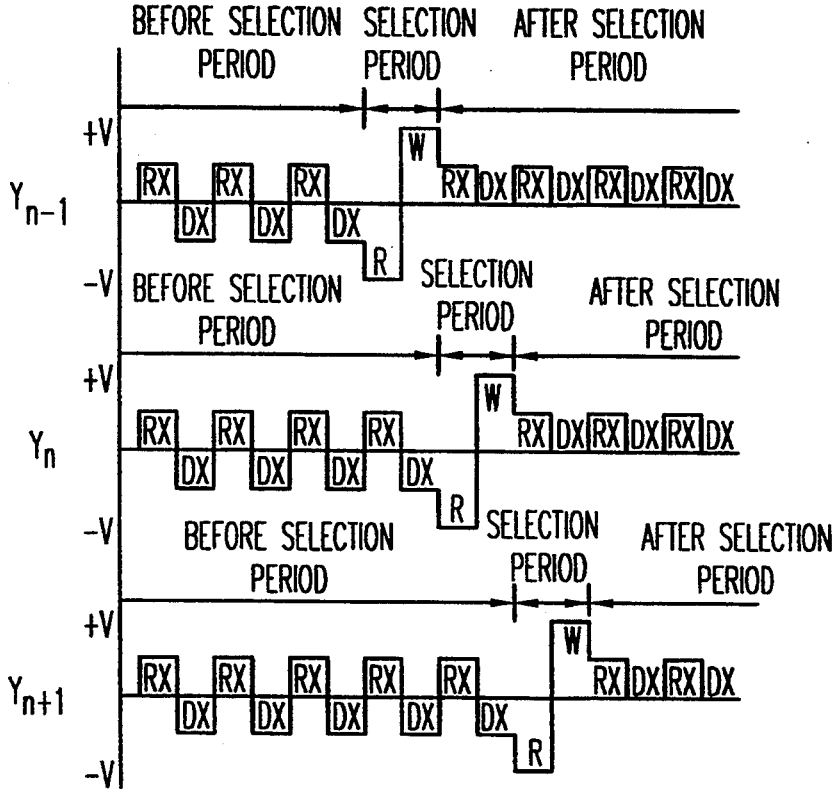
FIG. 5 is a time chart showing pulses applied to scanning signal lines of a dot-matrix display device by an active matrix driving apparatus in another example of the present invention.
Figure 6:
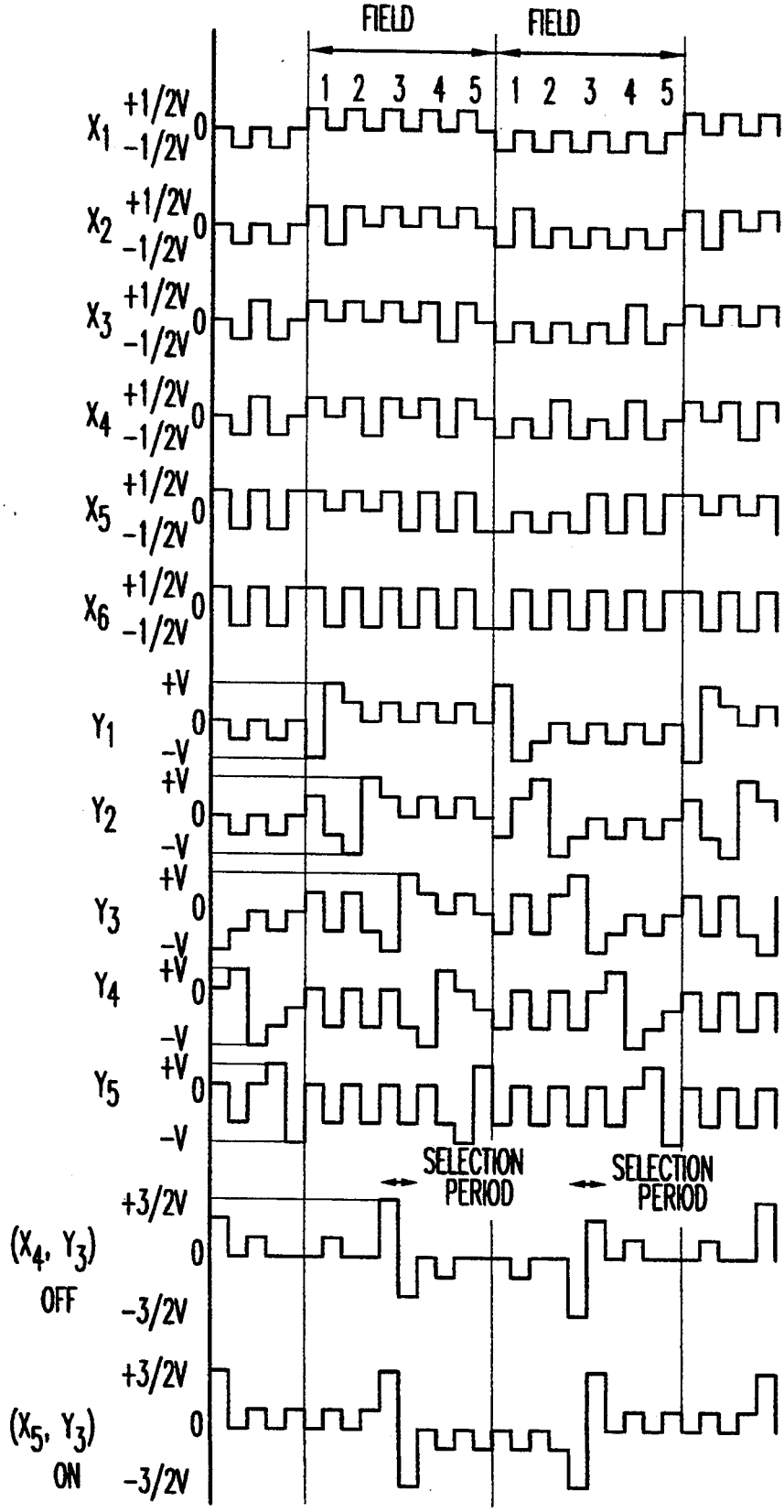
FIG. 6 is a time chart showing pulses applied to data signal lines and scanning signal lines of an active matrix display device having 5×6 pixels.

An active matrix driving apparatus and method in a second example of the present invention will be described with reference to FIGS. 5 and 6. FIG. 5 is a time chart showing pulses applied to scanning signal lines by the active matrix driving apparatus. FIG. 6 is a time chart showing pulses applied to data signal lines and the scanning signal lines of a dot-matrix display device.

In the first example, an absolute value of the potential of each reset pulse R and each data writing pulse W is equal to an absolute value of the potential of each reset compensating pulse RX and each data writing prohibiting pulse DX. In the second example, as is shown in FIG. 5, an absolute value of the potential of each reset compensating pulse RX and each data writing prohibiting pulse DX is $\pm(\frac{1}{2})$V when the absolute value of the potential of each reset pulse R and each data writing pulse W is $\pm$V. The potential of the pulse applied to the scanning signal lines Y and the data signal lines X and the potential of the pulse applied to the area of the ferroelectric layer 5 corresponding to the pixel are as shown in Table 2.

TABLE 2

| | | Before selection period | | Selection period | | After selection period | |
|---|---|---|---|---|---|---|---|
| | | Reset pulse | Data pulse | Reset pulse | Data pulse | Reset pulse | Data pulse |
| Scanning signal line Y | | $+\frac{1}{2}$ V | $-\frac{1}{2}$ V | $-$V | $+$V | $+\frac{1}{2}$ V | 0 |
| Data signal line X | ON | $+\frac{1}{2}$ V | $-\frac{1}{2}$ V | $+\frac{1}{2}$ V | $-\frac{1}{2}$ V | $+\frac{1}{2}$ V | $-\frac{1}{2}$ V |
| | OFF | $+\frac{1}{2}$ V | 0 | $+\frac{1}{2}$ V | 0 | $+\frac{1}{2}$ V | 0 |
| Voltage on ferroelectric layer | ON | 0 | 0 | $+3/2$ V | $-3/2$ V | 0 | $-\frac{1}{2}$ V |
| | OFF | 0 | $+\frac{1}{2}$ V | $+3/2$ V | $-$V | 0 | 0 |

FIG. 6 shows waveforms of pulses applied to the data signal lines X and scanning signal lines Y. As the LCD device, the one having 5×6 pixels shown in FIG. 2 is used.

For example, areas of the ferroelectric layer 5 corresponding to pixels at ($X_4$, $Y_3$) and ($X_5$, $Y_3$) provided on the scanning signal line $Y_3$ are each supplied with a reset pulse R of $+(3/2)$V during a selection period in a first field. Then, the areas of the ferroelectric layer 5 corresponding to the pixels at ($X_4$, $Y_3$) and ($X_5$, $Y_3$) are each supplied with a data pulse of either $-$V or $-(3/2)$V. Each pixel is in a display state of ON or OFF by the difference in the potential of such data pulses. During a selection period in a second field, the above areas of the ferroelectric layer 5 are each supplied with pulses each having an opposite polarity to that of the pulse applied in the first field. Thus, the liquid crystal layer 3 is AC-driven. The areas of the ferroelectric layer 5 corresponding to the pixels at ($X_4$, $Y_3$) and ($X_5$, $Y_3$) are continually supplied with a pulse of $-(\frac{1}{2})$V which is identical in the potential with that of the data pulse applied immediately before the pulse or supplied with a pulse of 0 V throughout a period after application of the data pulse in the selection period of the first field until application of the data pulse in the selection period of the second field. Thereafter, throughout a period between application of the data pulses in the selection periods of two adjacent fields, a pulse of $\pm(\frac{1}{2})$V which is identical in the polarity with that of the data pulse immediately before the pulse or a pulse of 0 V is applied.

In the second example, the difference in the potential of the pulses applied to the above areas of the ferroelectric layer 5 for determining the display states of ON and OFF is smaller than the case in FIG. 1. Accordingly, the contrast of the displayed image is slightly lowered. Nonetheless, the active matrix driving apparatus and method still provides the same effect as that in the first example that the written data is retained in a uniform period irrespective of which order the pixels are scanned and that the loss of memory function of the ferroelectric layer 5 is prevented.

The contrast of the images displayed on the screen in the first and the second examples and the conventional example are compared. Assuming that the contrast obtained in the first example is 100, the contrasts obtained in the second example and the conventional example are 80 and 45, respectively. In both of the first and the second examples of the present invention, satisfactory contrast can be obtained. In the conventional example, however, the brightness of the image is recognizably uneven between an upper part and a lower part of the image.

In the first and the second examples, the binary display state of ON or OFF is stored in the ferroelectric layer 5. According to the present invention, degrees of gradation can also be stored in the ferroelectric layer 5. The data writing prohibiting pulse DX is not limited to those described in the first and the second examples as long as the pulse applied to the areas of the ferroelectric layer 5 corresponding to the pixels always has a potential of an identical polarity with that of the pulse applied immediately before the data pulse or of 0 V.

In the first and the second examples, the polarities of pulses are inverted field by field. The present invention can be applied to a case where the polarities of pulses are inverted frame by frame. In the field-by-field inversion, the absolute value of the potential of the data writing prohibiting pulse DX is different between the non-selection period from the beginning of the field until the beginning of the only selection period of the field and the non-selection period from the end of the selection period until the end of the field. In the case of the frame-by-frame inversion, the absolute value of the potential of the data writing prohibiting pulse DX should be different between a period from a beginning of the frame until a beginning of the selection period in the first field, i.e., the earliest selection period of the frame and another period from an end of the selection period in the first field until an end of the frame.

Further, the present invention may be used for a display device utilizing electroluminescence or an electrochromic phenomenon as well as an LCD device or a data processing apparatus.

The apparatus for which the present invention is applied may have an arbitrary active matrix structure.

In an active matrix driving apparatus and method according to the present invention, an area of the ferroelectric layer 5 corresponding to each pixel is supplied with a reset pulse immediately before the application of a data pulse in each selection period. Therefore, the written data can be retained in a uniform period between two adjacent selection periods irrespective of which order the pixels are scanned. Such an active matrix driving apparatus and method can be used in a wide variety of devices including display devices. By applying a reset pulse immediately before the application of a data pulse, loss of the memory function of the ferroelectric layer 5 is lost by an invalid pulse having an opposite polarity to that of a data pulse applied immediately before the invalid pulse can be prevented.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An active matrix driving method for driving a display apparatus including a plurality of pixels for receiving image data, a ferroelectric member for controlling the plurality of the pixels, and a plurality of scanning signal lines and a plurality of data signal lines for driving the plurality of the pixels utilizing a memory function caused by spontaneous polarization of the ferroelectric member, the active matrix driving method comprising the steps of:

applying a reset pulse having a first polarity and a data writing pulse having a second polarity to one scanning signal line selected from the plurality of the scanning signal lines throughout a specified selection period;

applying a reset pulse having the second polarity and a data pulse having the first polarity or a level of 0 to each of the plurality of the data signal lines in synchronization with the reset pulse and the data writing pulse applied to the selected scanning signal line;

applying a reset compensating pulse having the second polarity and a data writing prohibiting pulse having the first polarity or a level of 0 to the selected scanning signal line throughout a period other than the specified selection period; and applying a reset pulse having the second polarity and a data pulse having the first polarity or a level of 0 to each of the plurality of the data signal lines in synchronization with the reset compensating pulse and the data writing prohibiting pulse applied to the selected scanning signal line.

2. An active matrix driving method according to claim 1, wherein an absolute value of the reset compensating pulse is equal to an absolute value of the reset pulse, and an absolute value of the data writing prohibiting pulse is equal to or less than an absolute value of the data pulse, throughout a period other than the specified selection period.

3. An active matrix driving method according to claim 1, wherein the specified period is included in a field, and the method further comprises the step of inverting the first polarity and the second polarity field by field.

4. An active matrix driving method according to claim 1, wherein:

the specified period is included in a field;

the data writing prohibiting pulse has the first polarity from a beginning of the field to a beginning of the specified selection period, and the data writing prohibiting pulse has a level of 0 from an end of the specified selection period to an end of the field; and the method further comprises the step of inverting the first polarity and the second polarity field by field.

5. An active matrix driving method according to claim 1, wherein at least one specified selection period is included in a frame; and the method further comprises the step of inverting the first polarity and the second polarity frame by frame.

6. An active matrix driving method according to claim 1, wherein:

at least one specified selection period is included in a frame;

the data writing prohibiting pulse has the first polarity from a beginning of the frame to a beginning of the earliest specified selection period of at least one specified selection period, and the data writing prohibiting pulse has a level of 0 from an end of the first specified selection period to an end of the frame; and the method further comprises the step of inverting the first polarity and the second polarity frame by frame.

7. An active matrix driving apparatus for driving a display device including a plurality of pixels for receiving image data, a ferroelectric member for controlling the plurality of the pixels, and a plurality of scanning signal lines and a plurality of data signal lines for driving the plurality of the pixels utilizing a memory function caused by spontaneous polarization of the ferroelectric member, the active matrix driving apparatus comprising:

scanning signal driving means for applying a reset pulse having a first polarity and a data writing pulse having a second polarity to one scanning signal line selected from the plurality of the scanning signal lines throughout a specified selection period, and for applying a reset compensating pulse having the second polarity and a data writing prohibiting pulse having the first polarity or a level of 0 to the selected scanning signal line throughout a period other than the specified selection period; and data signal driving means for applying a reset pulse having the second polarity and a data pulse having the first polarity or a level of 0 to each of the plurality of the data signal lines in synchronization with the reset pulse and the data writing pulse applied to the selected scanning signal line throughout the specified selection period, and for applying a reset pulse having the second polarity and a data pulse having the first polarity or a level of 0 to each of the plurality of the data signal lines in synchronization with the reset compensating pulse and the data writing prohibiting pulse applied to the selected scanning signal line throughout a period other than the specified selection period.

* * * * *